US009452624B2

(12) United States Patent
Ipponyari et al.

(10) Patent No.: US 9,452,624 B2
(45) Date of Patent: Sep. 27, 2016

(54) PRINTING POSITION AND CUTTING POSITION ADJUSTING METHOD

(71) Applicant: MIMAKI ENGINEERING CO., LTD., Nagano (JP)

(72) Inventors: Tadanori Ipponyari, Nagano (JP); Shinya Nishizawa, Nagano (JP); Yuu Nakazawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/924,732

(22) Filed: Oct. 28, 2015

(65) Prior Publication Data

US 2016/0121630 A1 May 5, 2016

(30) Foreign Application Priority Data

Oct. 31, 2014 (JP) ..... 2014-223769

(51) Int. Cl.
*B41J 11/66* (2006.01)
*B41J 29/38* (2006.01)

(52) U.S. Cl.
CPC ..... *B41J 11/663* (2013.01); *B41J 29/38* (2013.01)

(58) Field of Classification Search
CPC ..... B41J 11/663
See application file for complete search history.

(56) References Cited

U.S. PATENT DOCUMENTS

2010/0111587 A1* 5/2010 Johnson ..... B41J 11/46 400/619
2010/0119282 A1* 5/2010 Olsen ..... B41J 3/407 400/621
2011/0048266 A1* 3/2011 Crystal ..... B41J 3/4073 101/483

FOREIGN PATENT DOCUMENTS

JP 2005014594 A * 1/2005
JP 2006-95822 4/2006

* cited by examiner

*Primary Examiner* — Daniel J Colilla
(74) *Attorney, Agent, or Firm* — Jianq Chyun IP Office

(57) ABSTRACT

A printing position and cutting position adjusting method includes: printing on a medium an origin point adjusting image having multiple checking blocks using an ink-jet head; cutting the medium using a cutting head along a contour of the origin point adjusting image; removing a part of the medium cut by the cutting head from the medium; and inputting an amount of misalignment between a position at which the image is printed on the medium and a position at which the medium is cut to a controller. The amount of misalignment is inputted as a correction value between the printing position and the cutting position. The printing of the origin point adjusting image or the cutting of the medium includes a check process of producing a position shift per a predetermined dimension by each checking block in a main scanning direction or a sub scanning direction of the ink-jet head.

8 Claims, 13 Drawing Sheets

PRINTING POSITION AND CUTTING POSITION ADJUSTING METHOD

CROSS REFERENCE TO RELATED APPLICATIONS

This application claims the priority benefit of Japanese Patent Application No. 2014-223769, filed on Oct. 31, 2014. The entirety of the above-mentioned patent application is hereby incorporated by reference herein and made a part of this specification.

TECHNICAL FIELD

The disclosure relates to a printing position and cutting position adjusting method.

DESCRIPTION OF THE BACKGROUND ART

Some of conventional ink-jet printers are structured to print an object on a print medium and then cut the medium in accordance with the printed image. An example of such ink-jet printers is an ink-jet printer equipped with a cutting head described in Patent Document 1. This ink-jet printer has a cutting head and an ink-jet head, wherein an image is printed on a medium by the ink-jet head, and the image-printed medium is cut by the cutting head along, for example, the contour of the printed image.

[Patent Document 1]JP 2006-95822 A.

When an image is printed on a medium and the image-printed medium is then cut in accordance with the image printed thereon as described in the prior art document, adjustment of origin points is necessary beforehand. Specifically, it is necessary to adjust an origin point based on which the image is printed by the ink-jet head and an origin point based on which the image-printed medium is cut by the cutting head before the printing and cutting operations actually start. The origin point adjustment is performed, for example, as described below. An origin point adjusting image stored in the ink-jet printer is printed on a medium to generate cutting data based on this printed image. Then, the medium is cut based on the generated cutting data by the cutting head along the contour of the printed image. After the medium is cut, any misalignment between the printed image and cut part is checked. Then, positions of the printing origin point and the cutting origin point are adjusted based on the detected misalignment in order for the position of cutting by the cutting head and the contour position of the printed image to match with each other.

The origin point adjustment, however, requires an operator to perform the steps below; visually check an amount of misalignment, adjust the printing and cutting origin points in accordance with the amount of misalignment, and then perform the printing and cutting operations again using the origin point adjusting image to recheck the adjusted origin points. Thus, adjustment of the printing and cutting origin points conventionally entails a very complicated procedure.

SUMMARY

Faced with the conventional disadvantage, the disclosure described herein provides a printing position and cutting position adjusting method that may facilitate adjustment of printing and cutting origin points.

To overcome the disadvantage, the disclosure provides a printing position and cutting position adjusting method including: printing on a medium an origin point adjusting image having a plurality of checking blocks using an ink-jet head that discharges an ink on the medium for printing; cutting the medium using a cutting head along contour of the origin point adjusting image; removing a part of the medium cut by the cutting head from the medium; and inputting an amount of misalignment between a position at which the image is printed on the medium and a position at which the medium is cut to a controller that controls the ink-jet head and the cutting head, the amount of misalignment being inputted as a value of correction between the position of printing by the ink-jet head and the position of cutting by the cutting head, wherein the printing of the origin point adjusting image or the cutting of the medium includes a check process of producing a position shift per a predetermined dimension by each of the plurality of checking blocks in a main scanning direction or a sub scanning direction of the ink-jet head.

The method of the disclosure advantageously performs the printing of the origin point adjusting image or the cutting of the medium, while concurrently producing a position shift per a predetermined dimension by each of the checking blocks in the main scanning direction or the sub scanning direction of the ink jet head. Therefore, any amount of misalignment between the printing position and the cutting position may be easily calculated and obtained. Then, a value of correction between the printing position and the cutting position may be easily calculated and obtained. By inputting the value of correction to the controller, the printing and the cutting may be performed respectively at the printing position and the cutting position adjusted to locate at substantially the same position. This may advantageously facilitate adjustment of the printing and cutting origin points.

In the printing position and cutting position adjusting method, the check process is preferably performed during the cutting of the medium.

By thus performing the check process during the cutting of the medium, the amount of misalignment between the printing position and the cutting position may be more accurately calculated and obtained. When an image is printed, a selected print mode may affect the printing position to more or less change relative to image data. Performing the check process during the printing of the origin point adjusting image, therefore, possibly invites failure to accurately calculate the amount of misalignment. On the other hand, the cutting head, when cutting the medium, solely relies upon coordinates in the main scanning direction and the sub scanning direction. By performing the check process during the cutting of the medium, the amount of printing-cutting misalignment may be accurately calculated. This may advantageously ensure high accuracy in adjustment of the printing and cutting origin points.

In the printing position and cutting position adjusting method, the checking blocks of the origin point adjusting image are preferably coupled by a coupling section.

According to the disclosure wherein the checking blocks of the origin point adjusting image are coupled by the coupling section, a part of the medium printed with the origin point adjusting image may be readily removed from the medium. This may advantageously further facilitate adjustment of the printing and cutting origin points.

In the printing position and cutting position adjusting method, the check process is preferably performed in the main scanning direction and the sub scanning direction, respectively.

According to the disclosure wherein the check process is performed in the main scanning direction and the sub scanning direction respectively, the amount of misalignment between the printing position and the cutting position may be calculated for both of the directions. Then, the printing position and the cutting position may be adjusted to locate at substantially the same position in both of the main and sub scanning directions. This may advantageously provide more reliable adjustment of the printing and cutting origin points.

In the printing position and cutting position adjusting method, the origin point adjusting image is preferably printed such that an image subjected to the check process in the main scanning direction and an image subjected to the check process in the sub scanning direction are respectively printed on the medium.

According to the disclosure, the origin point adjusting image subjected to the check process in the main scanning direction and the origin point adjusting image subjected to the check process in the sub scanning direction are respectively printed on the medium. This may further facilitate more accurate calculation of the amount of misalignment between the printing position and the cutting position in the main scanning direction and the sub scanning direction. Consequently, adjustment of the printing and cutting origin points may be further facilitated and improved in accuracy.

The printing position and cutting position adjusting method described herein may advantageously and effectively facilitate adjustment of the printing and cutting origin points.

DETAILED DESCRIPTION OF EMBODIMENTS

Hereinafter, embodiments of a printing position and cutting position adjusting method according to the disclosure are described in detail referring to the accompanying drawings. It should be understood that implementations disclosed herein are not restricted by the embodiments. The structural elements described in the embodiments may be replaced with other possible options by those skilled in the art, and may include easily obtainable or substantially identical elements.

First Embodiment

Figure 1:
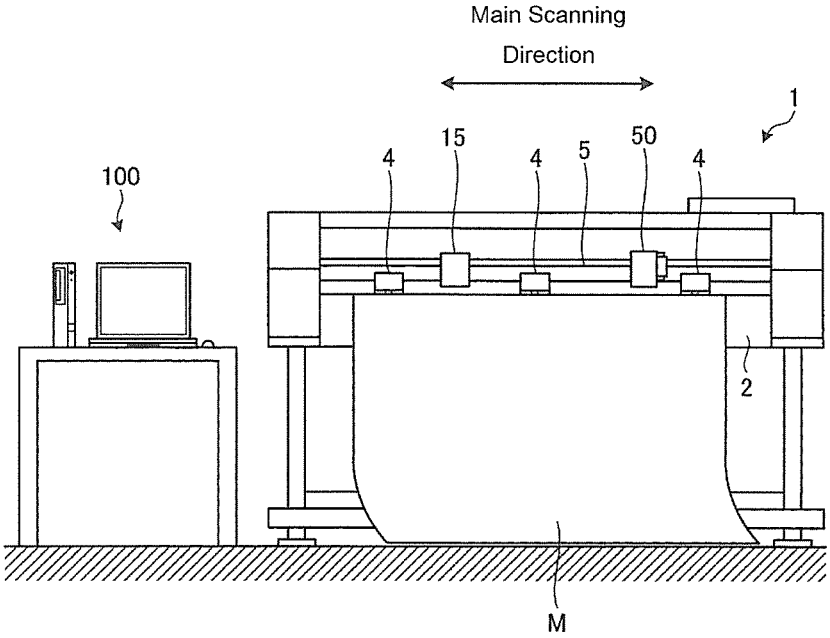
FIG. 1 is a front view of an ink-jet printer equipped with a cutting head that performs printing and cutting using a printing position and cutting position adjusting method according to a first embodiment.

FIG. 1 is a front view of an ink-jet printer equipped with a cutting head that performs printing and cutting using a printing position and cutting position adjusting method according to a first embodiment. An ink-jet printer 1 with a cutting head (hereinafter, ink-jet printer) illustrated in FIG. 1 has, in addition to its function to perform ink-jet printing on a print medium M, a function to cut the medium M.

The ink-jet printer 1 has an ink-jet head 15 that discharges an ink on the medium M to print an object thereon, and a cutting head 50 used to cut the medium M. The ink-jet head 15 and the cutting head 50 are disposed at positions facing a print surface of the medium M. The ink-jet head 15 and the cutting head 50 are mounted to a guide rail 5 extending in a main scanning direction and movable along the guide rail 5. The ink-jet head 15 and the cutting head 50 are accordingly movable in the main scanning direction orthogonal to a sub scanning direction which is a feeding direction of the medium M.

Referring to FIG. 1, the ink-jet head 15 and the cutting head 50 are located at positions above the medium M for illustrative purpose. When the ink-jet printer 1 is active, one of the ink-jet head 15 and the cutting head 50 moves away from above the medium M. The ink-jet head 15 and the cutting head 50, whenever neither of them is used, they both move away from above the medium M.

The ink-jet printer 1 thus structurally characterized is connected to a computer 100 such as a personal computer and controllable by the computer 100. In the computer 100 are pre-stored data and programs used to control the ink-jet printer 1. By running the programs, the computer 100 is operable to control the ink-jet printer 1.

Figure 2:
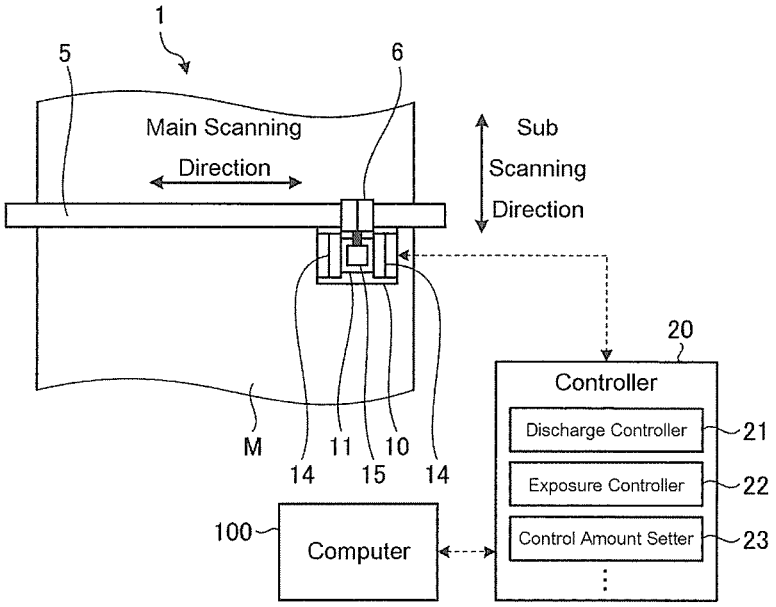
FIG. 2 is a plan view of an ink-jet head of the ink-jet printer illustrated in FIG. 1.

FIG. 2 is a plan view of an ink-jet head of the ink-jet printer illustrated in FIG. 1. The guide rail 5 is mounted with a carriage 10 that is allowed to move in the main scanning direction along the guide rail 5. The carriage 10 has a holder 11 for holding the ink-jet head 15, and a pair of ultraviolet lamps 14 attached to lateral sides of the holder 11 in the main scanning direction. The ink-jet head 15 thus held in the holder 11 and then loaded in the carriage 10 is allowed to move in the main scanning direction. The carriage 10 has an ink tank 6. The ink tank 6 mounted to the carriage 10 stores therein the ink to be discharged on the medium M by the ink-jet head 15. When the carriage 10 moves in the main scanning direction, the ink tank 6 is capable of moving integrally with the carriage 10.

The ink-jet head 15 is structured to discharge the ink stored in the ink tank 6 on the medium M. The ink-jet head 15 includes such structural elements as nozzles 31 facing the medium M to discharge the ink thereon (see FIG. 3), ink flow paths that provide connection between the ink tank 6 and the nozzles 31, and regulators and pumps disposed on the ink flow paths. By driving the pumps, the ink-jet head 15 having the plural nozzles 31 performs ink-jet discharge of the ink from the ink tank 6 toward the medium M through each of the nozzles 31 in a predetermined quantity.

The ultraviolet lamps 14 irradiate ultraviolet for light exposure of the ink discharged on the medium M. The ultraviolet lamps 14, for example, include ultraviolet-emitting LED modules.

A controller 20 is in charge of controlling the structural elements of the ink-jet printer 1. The controller 20 includes, in terms of functional concepts, for example, a discharge controller 21, an exposure controller 22, and a control amount setter 23. The controller 20 further includes hardware devices such as a computing device and a memory, and programs that effectuate predetermined functions of these devices. The computer 100 connected to the ink-jet printer 1 is further connected to the controller 20. The controller 20 is capable of transmitting and receiving information to and from the computer 100.

The discharge controller 21 of the controller 20 controls the pumps of the ink-jet head 15, thereby controlling the quantity, timing, and duration of the ink discharge from the ink-jet head 15. The exposure controller 22 controls the ultraviolet lamps 14, thereby regulating the intensities of ultraviolet irradiated from the ultraviolet lamps 14, and timings and durations of light exposure. The control amount setter 23 generates print patterns based on information inputted from the computer 100 connected to the controller 20 to set controlled variables of the ink discharge and light exposure.

Figure 3:
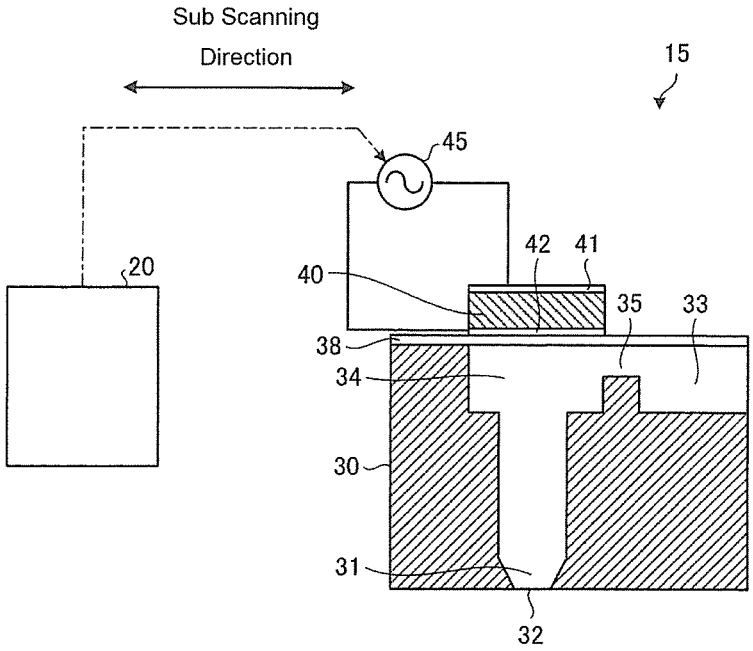
FIG. 3 is a detailed view of the ink-jet head illustrated in FIG. 2.

FIG. 3 is a detailed view of the ink-jet head illustrated in FIG. 2. The ink-jet head 15 has a body 30, nozzles 31, an inlet 33, an ink chamber 34, a diaphragm 38 as a vibratory member, and piezoelectric elements 40. The nozzles 31 extend along the vertical direction of the body 30 when the ink-jet head 15 is held by the carriage 10. The nozzles 31 each have a discharge port 32 at its lower end. The ink is discharged through the discharge port 32.

The inlet 33 is connected to the nozzles 31 by way of a groove 35 formed in the body 30. The ink chamber 34 is formed in communication with the nozzles 31 and the inlet 33. The ink chamber 34 is formed on the vertically upper side of the nozzles 31 in the body 30. The diaphragm 38 is disposed on the vertically upper side of the ink chamber 34, facing the ink chamber 34.

The piezoelectric element 40 works as an actuator that drives the nozzle 31 to discharge the ink. There are piezoelectric elements 40 correspondingly to respective ones of the nozzles 31 of the ink-jet head 15. The piezoelectric element 40 includes an element that provokes vibration of the diaphragm 38. The piezoelectric elements 40 are formed in layers on a surface of the diaphragm 38 opposite to the ink chamber 34. The piezoelectric elements 40 thus located each include, for example, a piezo element utilizing the generally known piezoelectric effect that refers to conversion of pressure applied thereto into voltage or applied voltage into pressure. The piezoelectric element 40 has an upper electrode 41 and a lower electrode 42 stacked in layers. The upper electrodes 41 and the lower electrodes 42 are connected to an electric power unit 45 that supplies power to the piezoelectric elements 40.

The electric power unit 45 is connected to a driver circuit that supplies a drive voltage to the piezoelectric elements 40. The driver circuit is controlled by the controller 20. Thus, the controller 20 further includes a function to serve as a discharge controller that controls the voltage applied to drive the piezoelectric elements 40, or actuators.

Figure 4:
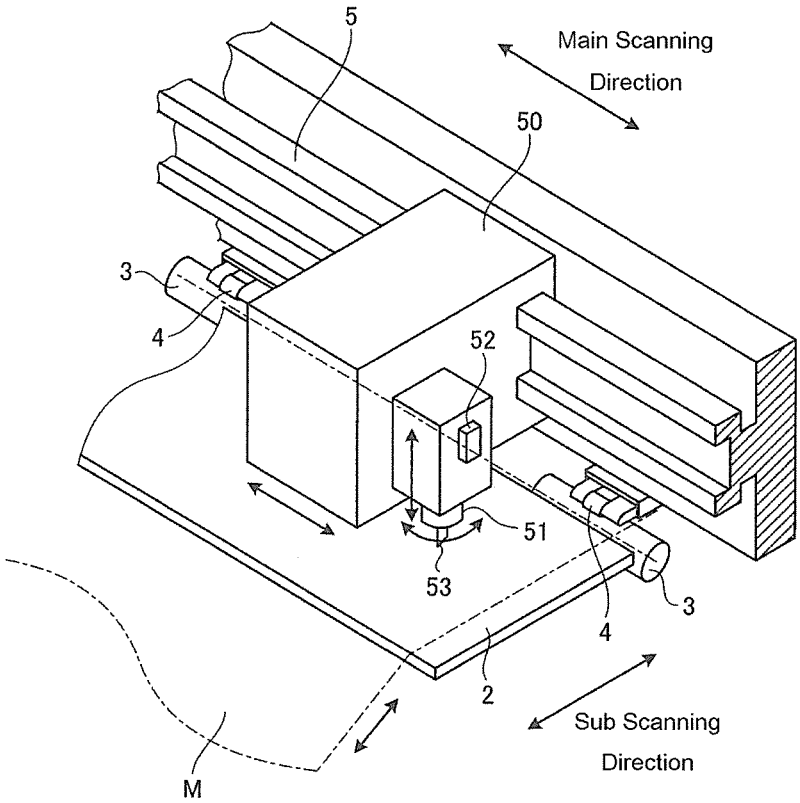
FIG. 4 is a perspective view of a peripheral area of the cutting head illustrated in FIG. 1.
Figure 5:
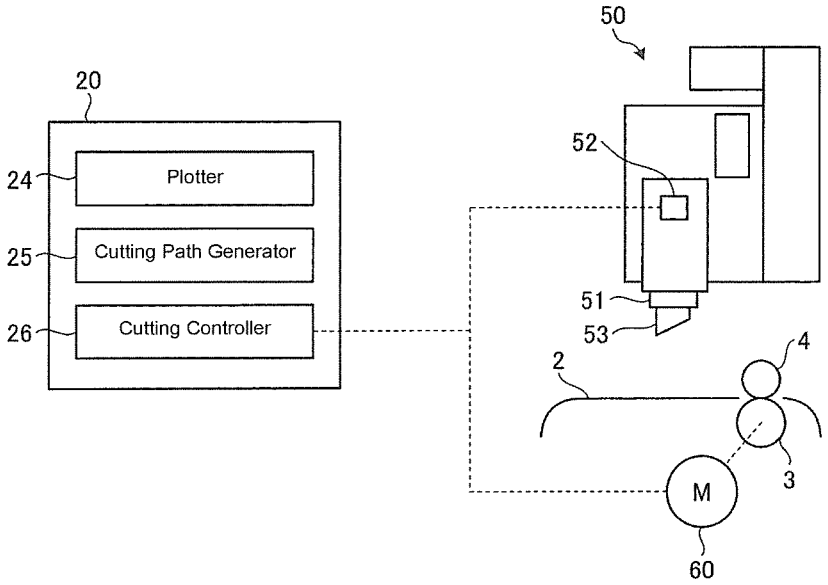
FIG. 5 is a structural view of the cutting head illustrated in FIG. 4.

FIG. 4 is a perspective view of a peripheral area of the cutting head illustrated in FIG. 1. FIG. 5 is a structural view of the cutting head illustrated in FIG. 4. The ink-jet printer 1 has a platen 2 provided as a supporting table for the medium M, and an upper part of the ink-jet printer 1 which is exposed on the upper surface of the platen 2. The ink-jet printer 1 further has a plurality of grid rollers 3 for moving the medium M and a plurality of pinch rollers 4 disposed correspondingly to respective ones of the grid rollers 3. The grid rollers 3 are placed at given intervals in the main scanning direction and driven by a conveyor motor 60 installed as a power source that drives the feed of the medium M.

The pinch rollers 4 are located on the upper side of the platen 2. The pinch rollers are energized toward the grid rollers 3 under a predetermined pressure and thereby rotatable in concert with the grid rollers 3. With the medium M being interposed between the grid rollers 3 and the pinch rollers 4, the ink-jet printer 1 rotates the grid rollers 3, thereby feeding the medium M in the sub scanning direction.

As with the ink-jet head 15, the cutting head 50 is movable along the guide rail 5 in the main scanning direction. The cutting head 50 has holder 51 to which various cutter blades 53 are attachable. The holder 51 is holding the cutter blade 53 with its blade edge directed toward the medium M. The holders 51 are structured to freely rotate around a rotational axis extending in a direction orthogonal to the medium M. The holders 51 rotate in concert with movements of the cutting head 50 in the main and sub scanning directions relative to the medium M. The holders 51 are accordingly allowed to perform an action generally called "dummy cut" to turn the cutter blades 53 in the cutting direction. This dummy cut refers to cutting of useless parts of the medium M, such as its corner parts, along straight cutting lines in an approximately 5-mm width in order for the cutter blades 53 to be turned in the direction of the cutting lines. According to the first embodiment, the cutter blades 53 are changed in direction by the dummy cut.

The holder 51 is capable of keeping an angle of rotation of cutter blade 53 at predetermined angle by an actuator 52, such as solenoid. The rotation of the holder 51 is allowed to be fixed temporarily by the actuator 52 to keep the cutter blade 53 in a posture toward to a predetermined direction in performing the dummy cut. For example, the rotation of the holder 51 is allowed to be fixed by pushing a movable portion of the solenoid against the holder 51.

As with the ink-jet head 15, the cutting head 50 is controllable by the controller 20. The controller 20 has, as its functional elements, a plotter 24 that plots cutting data used to cut the medium M, a cutting path generator 25 that generates cutting paths of the cutting data, and a cutting controller 26 that controls the cutting of the medium M by the cutting head 50 in accordance with the cutting paths. The controller 20, with these functional elements, controls the ink-jet head 15 and the cutting head 50.

The computer 100 is connected to the ink-jet printer 1 with a dedicated cable such as a USB cable or a RS-232C cable, or through network or near field radio communication. The computer 100 may be a resource configured on the Internet.

So far were described the structural features of the ink-jet printer 1 wherein position alignment is performed by the printing position and cutting position adjusting method according to the first embodiment. The operation of the ink-jet printer 1 is hereinafter described. When the ink-jet printer 1 prints an image on the medium M, the controller 20, using image data stored in the computer 100, controls the respective devices of the ink-jet printer 1 to print out the image data. Specifically, under the control by the controller 20, the ink-jet printer 1, while concurrently moving the carriage 10 back and forth in the main scanning direction relative to the medium M, discharges the ink from the ink-jet head 15 within a predetermined print width on the print surface of the medium M. The ink suited for an intended printing is discharged through the nozzles 31 of the ink-jet head 15 to be landed on the medium M.

The ink discharge through the nozzles 31 of the ink-jet head 15 is described in further detail. To discharge the ink through the nozzles 31, the ink stored in the ink tank 6 is guided to the inlet 33 and temporarily stored in the ink chamber 34. After the ink is stored in the ink chamber 34, a voltage is applied to the piezoelectric elements 40 by the electric power unit 45 to drive the piezoelectric elements 40, as controlled by a control signal outputted from the discharge controller 21 of the controller 20.

The discharge controller 21 applies a voltage with a drive waveform to the piezoelectric elements 40. The drive waveform is a preset voltage waveform to drive the piezoelectric elements 40 as desired. The piezoelectric elements 40 are vibrated by the applied voltage. The piezoelectric elements 40 transmit their vibrations to the diaphragm 38, and the diaphragm 38 is vibrated in response to the vibrations transmitted from the piezoelectric elements 40. The ink of the ink chamber 34 runs toward the nozzles 31 in response to the vibration of the diaphragm 38 and is discharged through the discharge ports 32 of the nozzles 31. Thus, the ink-jet head 15 performs ink-jet discharge of the ink through the nozzles 31, and the discharged ink is landed on the medium M.

After the ink is landed on the medium M, the ink-jet printer 1, using the exposure controller 22 of the controller 20, controls irradiation of ultraviolet emitted from the ultraviolet lamps 14. First, the ultraviolet lamps 14 irradiate by predetermined timings relatively weak ultraviolet for light exposure of the ink to prevent the ink landed on the medium M from spreading, thereby controlling dot sizes of the ink and preventing smearing of the ink. This step is preliminary curing (pinning exposure). Then, the exposure controller 22 further controls the ultraviolet lamps 14 to irradiate relatively intense ultraviolet on the preliminarily cured ink to fully cure the ink. This step is full curing (curing exposure).

As described, the ink-jet printer 1 discharges the ink and cures the ink landed on the medium M. The ink-jet printer 1 performs the printing in a desired pattern by repeatedly moving the medium M in the feeding direction (sub scanning direction) relative to the carriage 10 within the predetermined print width. During that time, the discharge controller 21 of the controller 20 controls the quantity, timing, and duration of the ink discharge from the ink-jet head 15, and the exposure controller 22 of the controller 20 controls the intensities of ultraviolet irradiated from the ultraviolet lamps 14, and timings and durations of the pinning and curing exposures. The ink-jet printer 1 accordingly prints a desired character or graphic form on the medium M in accordance with a print pattern generated by the control amount setter 23 based on information inputted from the computer 100.

When the medium M is cut by the ink-jet printer 1, the cutting head 50 is operated based on the image data stored in the computer 100 to cut the medium M. The medium M may be cut in entirety in its thickness direction. The medium M, if it is a seal having plural sheets stacked in layers, may be cut in its thickness direction to such a depth that allows only a part of the sheets to be cut.

When the medium M is cut by the ink-jet printer 1, cutting data used to cut the medium M, for example, contour patterns in the image data stored in the computer 100, is plotted by the plotter 24 of the controller 20 based on the image data. After the cutting data is plotted, cutting paths for the cutting to be performed based on the cutting data are generated by the cutting path generator 25, and the cutting head 50 is controlled in accordance with the generated cutting paths. By combining the movements of the cutting head 50 in the main scanning direction and the medium M in the sub scanning direction, the medium M is cut in an optional direction. The cutting head 50 cuts the medium M in accordance with the cutting data, and the ink-jet printer 1 cuts the medium M along the contours of the image data stored in the computer 100.

The ink-jet printer 1 thus prints an image on the medium M and cut the image-printed medium M. In the event of misalignment between a printing origin point and a cutting origin point, however, the medium M may be cut at a position away from the printed image or may be cut at a position on the printed image. To avoid these events, the ink-jet printer 1 performs position alignment between the printing and cutting origin points using the printing position and cutting position adjusting method according to the first embodiment. The origin points described herein refer to reference positions in the main scanning direction and the sub scanning direction when an optional image is printed on the medium M and the medium M is cut along the image printed thereon.

Figure 6:
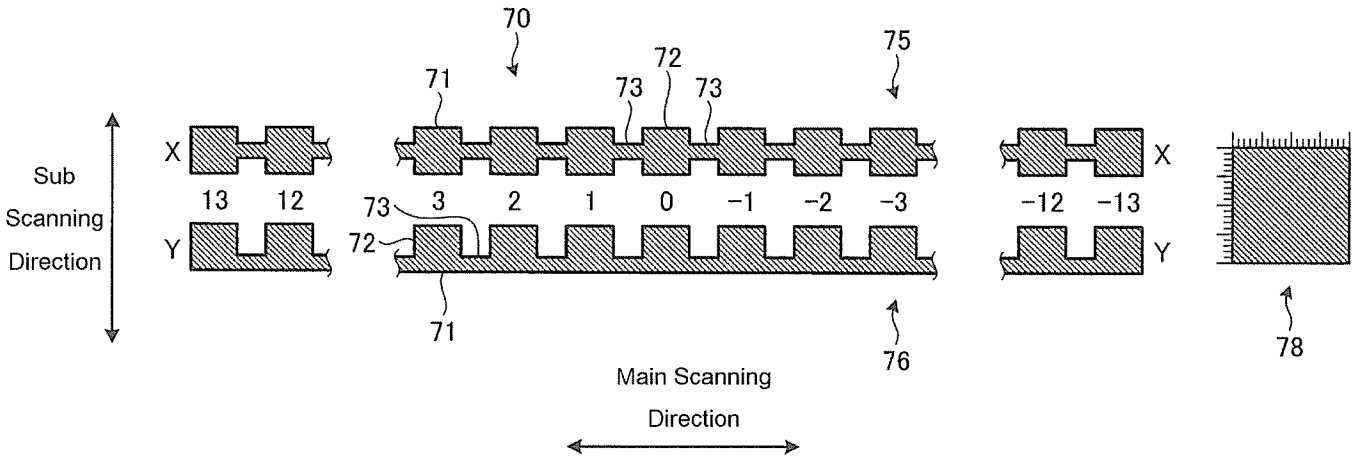
FIG. 6 is an explanatory drawing of an origin point adjusting image.

FIG. 6 is an explanatory drawing of an origin point adjusting image. For printing-cutting position alignment, a seal composed of layered sheets is used as the medium M, and an origin point adjusting image 70 is printed on the seal used as the medium M. The data of the origin point adjusting image 70, as well as the programs for control of the ink-jet printer 1, is stored in the computer 100. Upon implementing the printing-cutting position alignment on the computer 100, the computer 100 prompts the ink-jet printer 1 to print the origin point adjusting image 70 on the medium M.

At the time, the computer 100 prompts the ink-jet printer 1 to print the origin point adjusting image 70 on the medium M in a print mode selected in the ink-jet printer 1 to actually print images stored in the computer 100 on the medium M. The print mode selected then presents the following information; resolution of an image to be printed, paths indicating how many times when the ink-jet head 15 moves in the main scanning direction to finish the printing in an optional width in the sub scanning direction, and waveforms of a voltage applied to the piezoelectric element 40 of the ink-jet head 15. An image printed on the medium M with the ink discharged from the ink-jet head 15 may differ in quality and color expression by regulating the resolution, paths, and waveforms. Therefore, the print mode is a parameter useful to decide on details of an image to be printed on the medium M, materials of the medium M, and ingredients of the ink in order for the image to be optimally printed.

A user of the ink-jet printer 1, to prompt the ink-jet printer 1 to print the origin point adjusting image 70, inputs print mode settings to the computer 100, thereby selecting and setting the print mode selected to actually print images stored in the computer 100 on the medium M. Then, the origin point adjusting image 70 is printed on the medium M in the print mode selected to actually print images stored in the computer 100 on the medium M. The ink-jet printer 1, in response to an instruction signal received from the computer 100, instructing the printing of the origin point adjusting image 70, discharges the ink from the ink-jet head 15 to print the origin point adjusting image 70 on the medium M in the selected print mode. The ink-jet printer further prints, as well as the origin point adjusting image 70, information of the selected print mode on the medium M. An ink preferably used to print the origin point adjusting image 70 is a fast-drying ink with good color visibility, for example, a magenta ink.

The origin point adjusting image 70 thus printed has a plurality of checking blocks 72. Adjacent ones of these checking blocks 72 are coupled by a coupling section 73. Specifically, the checking blocks 72 are each an image of a substantially square shape, and the origin point adjusting image 70 is an image having the checking blocks 72 adjacently arranged in the main scanning direction of the ink-jet head 15. The coupling section 73 is an image that couples the checking blocks 72 adjacent to each other in the main scanning direction. The width of the coupling section 73 in the sub scanning direction is smaller than the width of the checking block 72 in the same direction.

In the origin point adjusting image 70 thus having the plural checking blocks 72 is included an X direction adjustment pattern 75 and a Y direction adjustment pattern 76. The X direction adjustment pattern 75 is for adjustment between the printing position and the cutting position in the X direction that is the sub scanning direction. The Y direction adjustment pattern 76 is for adjustment between the printing position and the cutting position in Y direction that is the main scanning direction. The X direction adjustment pattern 75 and the Y direction adjustment pattern 76 are printed on the medium M adjacent to each other in the sub scanning direction. In both of the X and Y direction adjustment patterns 75 and 76, the plural checking blocks 72 are adjacently arranged in the main scanning direction, and adjacent ones of these checking blocks 72 are coupled by the coupling section 73.

In the X direction adjustment pattern 75, adjacent ones of the checking blocks 72 are coupled by the coupling section 73 at or near center positions of the checking blocks 72 in the sub scanning direction. In the Y direction adjustment pattern 76, adjacent ones of the checking blocks 72 are coupled by the coupling section 73 at or near one ends of the checking blocks 72 in the sub scanning direction.

In the origin point adjusting image 70, "X" is printed in proximity of the X direction adjustment pattern 75, and "Y" is printed in proximity of the Y direction adjustment pattern 76. These characters are printed for clear distinction between the X direction adjustment pattern 75 and the Y direction adjustment pattern 76. In the origin point adjusting image 70, numerals, used as indicators of values of correction for the printing-cutting position alignment, are printed in proximity of the checking blocks 72 correspondingly to respective ones of the checking blocks 72. According to the first embodiment, integers of 13 to −13 are allocated to the respective checking blocks 72 and printed in proximity of the checking blocks 72. In the origin point adjusting image 70 according to the first embodiment, there are 27 checking blocks 72 in the X direction adjustment pattern 75 and the Y direction adjustment pattern 76, respectively.

The origin point adjusting image 70 further includes a graduated image 78 on two orthogonal sides among four sides of the square shape. The graduated image 78 is a square image larger than the checking block 72. The graduated image 78 is printed in proximity of the X direction adjustment pattern 75 and the Y direction adjustment pattern 76.

After the origin point adjusting image 70 is printed on the medium M, the computer 100 issues an instruction signal, instructing the cutting of the medium M along a contour 71 of the origin point adjusting image 70, to the ink-jet printer 1. The ink-jet printer 1, in response to the received instruction signal instructing the cutting of the medium M, cuts the medium M using the cutting head 50 along the contour 71 of the origin point adjusting image 70. This cutting is performed to a depth that allows a sheet facing the cutting head 50 alone to be cut among the sheets of the seal used as the medium M.

When the medium M is cut in this manner, the ink-jet printer 1, during the cutting, performs a check process of producing a position shift per a predetermined dimension by each of the checking blocks 72 in the main scanning direction or the sub scanning direction of the ink-jet head 15. The cutting data plotted by the plotter 24 of the controller 20 to cut the medium using the cutting head 50 is based on the image data stored in the computer 100. This cutting data, therefore, is generated based on the origin point adjusting image 70. Then, the position of cutting by the cutting head 50 is a position along the contour 71 of the origin point adjusting image 70. The check process shifts this cutting position by each of the checking blocks 72 relative to a position on the contour 71 of the checking block 72 in the origin point adjusting image 70. This position shift is produced per a predetermined dimension in the main scanning direction or the sub scanning direction.

When, for example, the medium is cut along the contour 71 of the X direction adjustment pattern 75, the cutting position is shifted per a predetermined dimension by each of the checking blocks 72 from the contour 71 of the checking block 72 relative to the adjacent checking block 72 in the sub scanning direction. The cutting of the X direction adjustment pattern 75 along its contour 71 is described in further detail. This cutting is performed with the cutting position being shifted in the sub scanning direction per a dimension; a numeral printed near each of the checking blocks 72×0.1 mm at a time, relative to a position on the contour 71 of the checking block 72 in the cutting data generated based on the image data. For the checking block 72 with the numeral 0 printed in its proximity, therefore, the cutting is performed along the generated cutting data. For the checking blocks 72 with any numerals but 0, the cutting is performed with the cutting position being shifted in the sub scanning direction relative to the cutting data based on an amount of misalignment corresponding to each of their numerals.

The cutting of the Y direction adjustment pattern 76 along the contour 71 of the Y direction adjustment pattern 76 is likewise. During the cutting, the cutting position is similarly shifted relative to the cutting data based on the numerals respectively printed in proximity of the checking blocks 72, with the exception of its shift direction. The Y direction adjustment pattern 76 is cut with the cutting position being shifted in the main scanning direction. Specifically, the cutting of the Y direction adjustment pattern 76 along its contour 71 is performed with the cutting position being shifted in the main scanning direction by a numeral printed in proximity of each checking block 72×0.1 mm at a time relative to a position on the contour 71 of the checking block 72 in the cutting data generated based on the image data. As to the Y direction adjustment pattern 76, the cutting is performed along the generated cutting data for the checking block 72 with the numeral 0 printed in its proximity. For the checking blocks 72 with any numerals but 0, on the other hand, the cutting is performed with the cutting position being shifted in the main scanning direction relative to the cutting data based on an amount of misalignment corresponding to each of their numerals.

Thus, the cutting of the X direction adjustment pattern 75 is performed with the cutting position being shifted in the sub scanning direction relative to the cutting data. On the other hand, the cutting of the Y direction adjustment pattern 76 is performed with the cutting position being shifted in the main scanning direction relative to the cutting data. Thus, the check process is performed in the main scanning direction and the sub scanning direction, respectively. To allow the check process to be performed in both of the main and sub scanning directions, the origin point adjusting image 70 has two patterns to be printed on the medium M; Y direction adjustment pattern 76 for the check process in the main scanning direction, and X direction adjustment pattern 75 for the check process in the sub scanning direction.

When the medium M is cut along the contour 71 of the origin point adjusting image 70, the graduated image 78 is also cut along the contour 71. Instead of shifting the cutting position of the graduated image 78 relative to the cutting data, the graduated image 78 is cut at a position corresponding to the contour 71 of the graduated image 78 in the cutting data.

Figure 7:
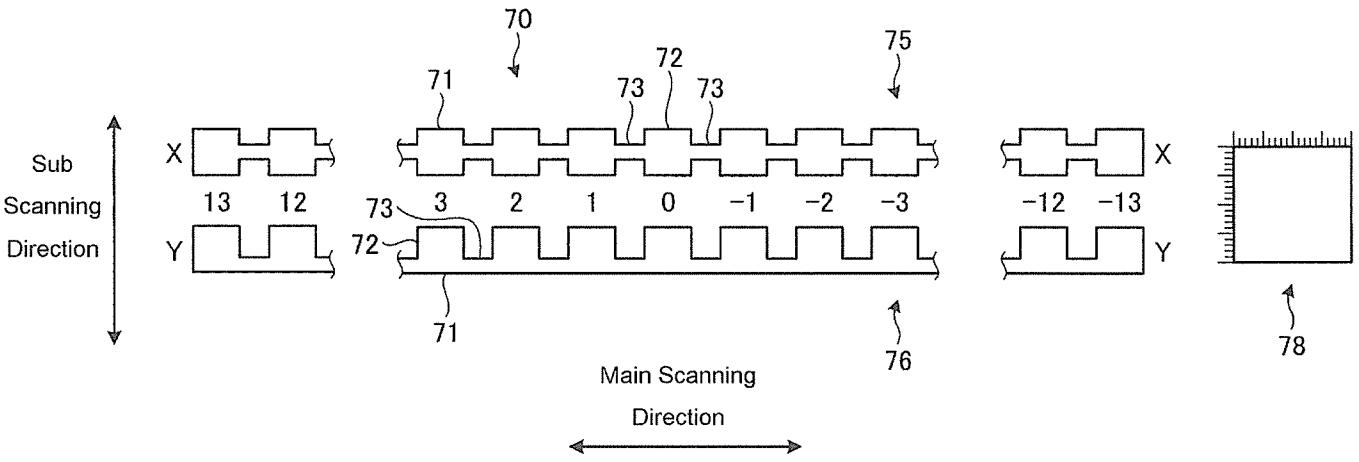
FIG. 7 illustrates a state in which a cut part has been peeled off.

FIG. 7 illustrates a state in which a cut part has been peeled off. The origin point adjusting image 70 is printed on the medium M, and the image-printed medium M is cut along the contour 71 of the origin point adjusting image 70. Then, a part of the medium M cut by the cutting head 50 is removed from the medium. The medium M is a seal having plural sheets stacked in layers. Of the layered sheets cut by the cutting head 50, a part of the medium printed with the origin point adjusting image 70 is removed by a user of the ink-jet printer 1. Of the checking blocks 72 in the X and Y direction adjustment patterns 75 and 76, adjacent ones are coupled with the coupling section 73. Therefore, a part of the medium printed with the X and Y direction adjustment patterns 75 and 76 respectively having the coupled checking blocks 72 may be removable at once.

Figure 8:
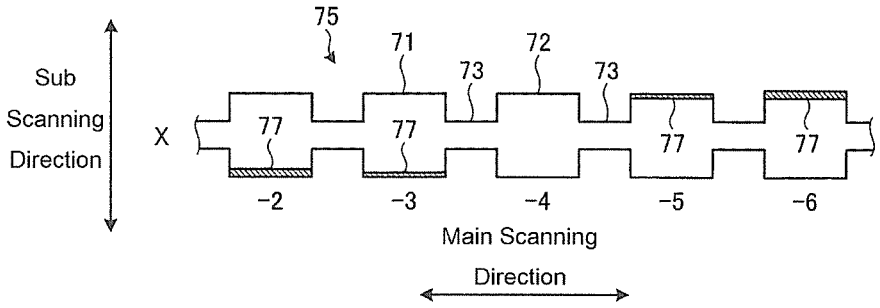
FIG. 8 is a detailed view of a principal part of an X direction adjustment pattern illustrated in FIG. 7.

FIG. 8 is a detailed view of a principal part of the X direction adjustment pattern illustrated in FIG. 7. The X direction adjustment pattern 75 is cut with the cutting position being shifted in the sub scanning direction relative to the cutting data by each of the checking blocks 72. During the cutting, therefore, the cutting position is shifted by each of the checking blocks 72 in the sub scanning direction relative to the contour 71 of the checking block 72. Then, removal of a part of the medium with the X direction adjustment pattern 75 printed thereon consequently leaves some of the printed image corresponding to the amount of misalignment between the contour 71 and the cutting position.

In the X direction adjustment pattern 75, an uncut part 77 of the printed image lies at one of two ends in the checking block 72 in the sub scanning direction. These uncut parts 77 of the X direction adjustment pattern 75 in the checking blocks 72 are left on the medium M in different widths in the sub scanning direction. The printing position and cutting position adjustment method according to the first embodiment decides a value of correction between the printing position and the cutting position in accordance with the widths of the uncut parts 77. This method specifically decides a value of correction for misalignment between the printing and cutting origin points.

In the event of misalignment in the sub scanning direction between the printing position of the medium M and the cutting position of the medium M, the printing position and the cutting position are shifted and corrected respectively in directions opposite to directions in which these positions are misaligned by a dimension corresponding to the amount of misalignment. Then, there may be no longer misalignment between the printing position and the cutting position. Of the uncut parts 77 left after the image of the X direction adjustment pattern 75 is removed, the amount of misalignment of the cutting position as compared to the cutting data in the checking block 72 with the uncut part 77 smallest in width in the sub scanning direction represents a value approximate to the misalignment between the printing and cutting origin points.

Therefore, the printing position and cutting position adjusting method according to the first embodiment picks out a numeral printed in proximity of the checking block 72 with the uncut part 77 smallest in width in the sub scanning direction among all of the uncut parts 77 after the image of the X direction adjustment pattern 75 is removed. Then, the method uses the numeral×0.1 mm as the amount of misalignment between the printing position of the medium M and the cutting position of the medium M in the sub scanning direction. Taking, for instance, the uncut parts 77 of the X direction adjustment pattern 75 left as illustrated in FIG. 8, the checking block 72 with the numeral of −4 printed in its proximity has no uncut part 77, or its uncut part 77 is smallest in width. In that case, −4×0.1 mm=−0.4 mm is the amount of misalignment between the printing position and the cutting position in the sub scanning direction.

Figure 9:
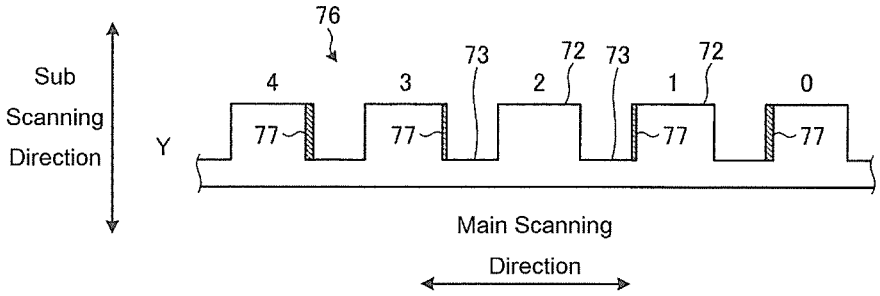
FIG. 9 is a detailed view of a principal part of a Y direction adjustment pattern illustrated in FIG. 7.

FIG. 9 is a detailed view of a principal part of the Y direction adjustment pattern illustrated in FIG. 7. In the event of misalignment in the main scanning direction between the printing position of the medium M and the cutting position of the medium M, the printing position and the cutting position are shifted and corrected respectively in directions opposite to directions in which these positions are misaligned by a dimension corresponding to the amount of misalignment. Then, there may no longer misalignment between the printing position and the cutting position. Of the uncut parts 77 left after the image of the Y direction adjustment pattern 76 is removed, the amount of misalignment of the cutting position as compared to the cutting data in the checking block 72 with the uncut part 77 smallest in width in the main scanning direction represents a value approximate to the misalignment between the printing and cutting origin points.

Therefore, the printing position and cutting position adjusting method according to the first embodiment picks out a numeral printed in proximity of the checking block 72 with the uncut part 77 smallest in width in the main scanning direction among all the uncut parts 77 left after the image of the Y direction adjustment pattern 76 is removed. Then, the method uses the numeral×0.1 mm as the amount of misalignment between the printing position of the medium M and the cutting position of the medium M in the main scanning direction. Taking, for instance, the uncut parts 77 of the Y direction adjustment pattern 76 left as illustrated in FIG. 9, the checking block 72 with the numeral of 2 printed in its proximity has no uncut part 77, or its uncut part 77 is smallest in width. In that case, 2×0.1 mm=0.2 mm is the amount of misalignment between the printing position of the medium M and the cutting position of the medium M in the main scanning direction.

The amount of misalignment between the origin points of the printing and cutting positions when cutting the medium M printed with the origin point adjusting image 70 may be obtained as described so far in both of the main and sub scanning directions. The amount of misalignment may also be obtained by the use of the graduated image 78. The graduated image 78 is printed on the medium M, and the image-printed medium M is cut along the contour 71 of the graduated image 78 in accordance with the cutting data generated based on the origin point adjusting image 70. After a part of the medium printed with the graduated image 78 is removed, some of the image is left uncut correspondingly to the amount of misalignment between the printing position and the cutting position. By reading the graduations of the graduated image 78 to know the respective widths of the uncut parts in the main and sub scanning directions, the amounts of misalignment between the printing position and the cutting position in both of the main and sub scanning directions may be calculated and obtained.

After the origin point adjusting image 70 is printed on the medium M and the image-printed medium M is cut with the check process being concurrently performed, the amounts of misalignment between the printing position and the cutting position are calculated and obtained. Then, the obtained amounts of misalignment are inputted to the controller 20 as values of correction. Specifically, the amounts of misalignment obtained from the origin point adjusting image 70 are inputted to the controller 20 as values of correction between the position of printing by the ink-jet head 15 and the position of cutting by the cutting head 50. With such amounts of misalignment as illustrated in FIGS. 8 and 9, for example, values of correction to be inputted are −0.4 mm for the sub scanning direction, and 0.2 mm for the main scanning direction.

The computer 100 transmits an instruction signal to the controller 20 of the ink-jet printer 1. The controller 20, in response to the received instruction signal, controls the ink jet head 15 and the cutting head 50. The values of correction, therefore, are to be inputted to the controller 20.

When an image stored in the computer 100 is printed by the ink-jet printer 1 on the medium M, and the image-printed medium M is then cut, the controller 20 that received the values of correction controls the image to be printed in a print mode suited for the image. Then, the medium M is cut at a position of the origin point corrected based on the inputted values of correction. Then, the ink-jet printer 1, regardless of the print mode selected therein, is operable to cut the medium M along the contour 71 at a position substantially coincident with the contour 71 of the image printed on the medium M.

Figure 10:
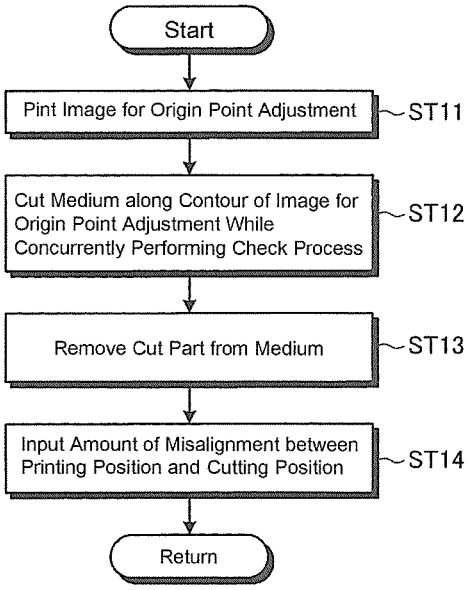
FIG. 10 is a flowchart of position alignment using the printing position and cutting position adjusting method according to the first embodiment.

FIG. 10 is a flowchart of position alignment using the printing position and cutting position adjusting method according to the first embodiment. The printing position and cutting position adjusting method according to the first embodiment performs, in the ink-jet printer 1, the steps described below for the printing-cutting position alignment with respect to the medium M. To start with, the method prints the origin point adjusting image 70 (Step ST11). For printing-cutting position alignment, the origin point adjusting image 70 pre-stored in the computer 100 is printed on the medium M by the ink-jet printer 1. The print mode selected then to print the image is a print mode suited for the other images stored in the computer 100.

Next, the medium M is cut along the contour 71 of the origin point adjusting image 70 with the check process being concurrently performed (Step ST12). As to the X direction adjustment pattern 75, the cutting is performed with the cutting position being shifted in the sub scanning direction relative to the cutting data by each of the checking blocks 72. As to the Y direction adjustment pattern 76, on the other hand, the cutting is performed with the cutting position being shifted in the main scanning direction relative to the cutting data by each of the checking blocks 72.

Then, the cut part is removed from the medium M (Step ST13). The medium M used in the first embodiment is a seal having plural sheets stacked in layers. Of the layered sheets facing and cut by the cutting head 50, a part of the medium M printed with the origin point adjusting image 70 is peeled off and removed.

Then, the amounts of misalignment between the printing position and the cutting position are inputted (Step ST14). By removing, from the medium M, its part printed with the origin point adjusting image 70, the amounts of misalignment in the main and sub scanning directions may be obtained based on the uncut parts 77 of the respective checking blocks 72. These amounts of misalignment are inputted to the controller 20 as values of correction between the printing position and the cutting position. When an image stored in the computer 100 is printed on the medium M and the image-printed medium M is cut by the ink-jet printer 1, the medium M is cut at a position of the origin point corrected based on the inputted values of correction. The medium M may be accordingly cut at a position substantially coincident with the contour 71 of the image printed on the medium M.

The printing position and cutting position adjusting method according to the first embodiment is characterized in cutting the medium M printed with the origin point adjusting image 70, while concurrently producing a position shift per a predetermined dimension by each of the checking blocks 72 in the main scanning direction or the sub scanning direction of the ink-jet head 15. Therefore, any amount of misalignment between the printing position and the cutting position may be easily calculated and obtained. Then, the value of correction between the printing position and the cutting position may be easily calculated and obtained. By inputting the value of correction to the controller 20, the printing and the cutting may be performed respectively at the printing position and the cutting position adjusted to locate at substantially the same position. This may advantageously facilitate adjustment of the printing and cutting origin points.

The check process of producing a position shift per a predetermined dimension by each of the checking blocks 72 in the main scanning direction or the sub scanning direction of the ink-jet head 15 is performed during the cutting of the medium M. Therefore, any amount of misalignment between the printing position and the cutting position may be more accurately calculated and obtained. When an image is printed by the ink-jet head 15, a selected print mode may affect the printing position to more or less change relative to the image data. Therefore, the value of correction for misalignment X, Y suitable for a selected print mode is stored in a prearranged memory to correct the cutting origin point using a value of correction meeting the image from the computer 100. Performing the check process during the printing of the origin point adjusting image 70 possibly invites failure to accurately calculate the amount of misalignment. On the other hand, the cutting head 50, when cutting the medium M, solely relies upon coordinates in the main scanning direction and the sub scanning direction. By performing the check process during the cutting of the medium M, the amount of printing-cutting misalignment may be accurately calculated. This may advantageously ensure high accuracy in adjustment of the printing and cutting origin points.

According to the disclosure, the checking blocks 72 in the origin point adjusting image 70 are coupled by the coupling section 73. When the medium M is cut, therefore, a part of the medium M printed with the origin point adjusting image 70 may be readily removed from the medium. This may advantageously further facilitate adjustment of the printing and cutting origin points.

Moreover, by performing the check process in the main and sub scanning directions respectively, the amounts of misalignment between the printing position and the cutting position in both of the directions may be calculated. Then, the printing position and the cutting position may be adjusted to locate at substantially the same position in both of the main and sub scanning directions. This may advantageously provide more reliable adjustment of the printing and cutting origin points.

When the origin point adjusting image 70 is printed, the Y direction adjustment pattern 76 subjected to the check process in the main scanning direction and the X direction adjustment pattern 75 subjected to the check process in the sub scanning direction are respectively printed on the medium M. This may further facilitate more accurate calculation of the amount of misalignment between the printing position and cutting position in both of the main and sub scanning directions. Consequently, adjustment of the printing and cutting origin points may be further facilitated and improved in accuracy.

In the X direction adjustment pattern 75, adjacent ones of the checking blocks 72 are coupled by the coupling section 73 at or near center positions of the checking blocks 72 in the sub scanning direction. Accordingly, the width of any uncut part 77 in the sub scanning direction may be more distinctly discernible. In the Y direction adjustment pattern 76, adjacent ones of the checking blocks 72 are coupled by the coupling section 73 at or near one ends of the checking blocks 72 in the sub scanning direction. Accordingly, the width of any uncut part 77 in the main scanning direction may be more distinctly discernible. Consequently, adjustment of the printing and cutting origin points may be further facilitated and improved in accuracy.

The origin point adjusting image 70 is printed in the same print mode as in the printing of the other images stored in the computer 100 on the medium M. When an image stored in the computer 100 is printed on the medium and the image-printed medium is cut after the printing-cutting origin points are adjusted, the medium may be cut at a position substantially coincident with the contour 71 of the printed image. This may advantageously succeed in precision cutting of an image printed on the medium M, enabling a sheet to be cut substantially exactly along the contour 71 of the image.

Using the values of correction thus obtained may also be advantageous when an image is printed on a cut medium, because cutting the medium based on the values of correction may allow for high-precision image printing. When the image printing follows the medium cutting, print mode information is transmitted from the computer 100 before the cutting data is transmitted, and the cutting origin point is corrected based on a value of correction meeting the information. Thus, performing the image printing after the medium is cut may likewise ensure accurate matching between the contour 71 of a printed image and its cutting shape.

Second Embodiment

A printing position and cutting position adjusting method according to a second embodiment is similar to the printing position and cutting position adjusting method according to the first embodiment, except that adjustment of the printing position and the cutting position is performed by way of graduations printed on the medium M. Any other technical features similar to those described in the first embodiment will not be described again but are simply illustrated with the same reference numerals.

Figure 11:
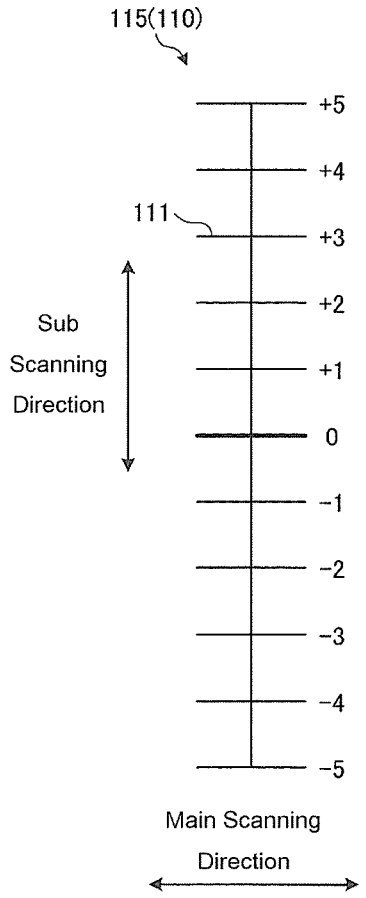
FIG. 11 is an explanatory drawing of an X direction adjustment pattern in an origin point adjusting image used in a printing position and cutting position adjusting method according to a second embodiment.

FIG. 11 is an explanatory drawing of an X direction adjustment pattern in an origin point adjusting image used in a printing position and cutting position adjusting method according to a second embodiment. An origin point adjusting image 110 used in the printing position and cutting position adjusting method according to the second embodiment has an image-side scale 111 marked with a plurality of graduations. In, for instance, an X direction adjustment pattern 115 as the origin point adjusting image 110 used for adjustment between the printing position and the cutting position in the sub scanning direction, the graduations of the image-side scale 111 are extending in the main scanning direction and spaced at certain intervals in the sub scanning direction. In proximity of the origin point adjusting image 110, numerals used as indicators of values of corrections for the printing-cutting position alignment are printed correspondingly to the graduations of the image-side scale 111, similarly to the origin point adjusting image 70 according to the first embodiment.

Figure 12:
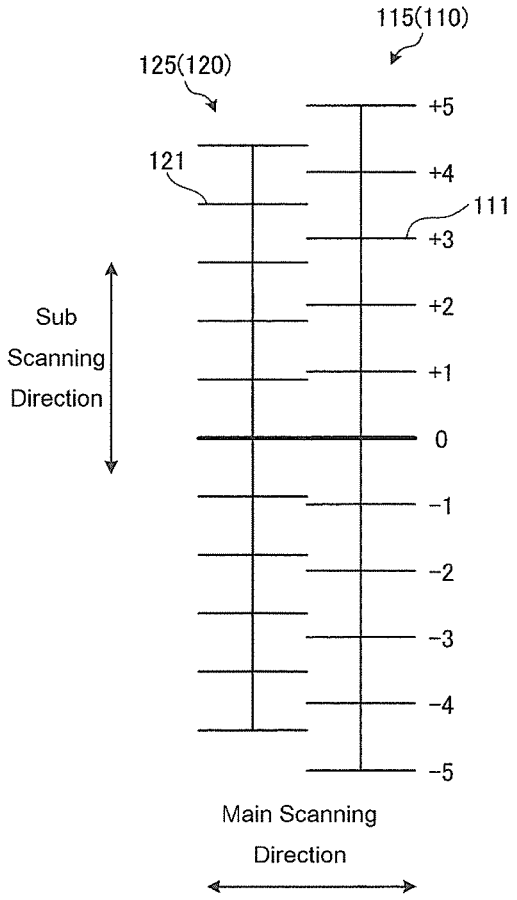
FIG. 12 is an explanatory drawing of a state in which a cutting pattern is applied in proximity of the origin point adjusting image illustrated in FIG. 11.

FIG. 12 is an explanatory drawing of a state in which a cutting pattern is applied in proximity of the origin point adjusting image illustrated in FIG. 11. After the origin point adjusting image 110 is printed on the medium M, the medium M is cut by the cutting head 50, and a cutting pattern 120 pre-stored in the computer 100 is applied in proximity of the origin point adjusting image 110 on the medium M. The cutting pattern 120 includes a cutting pattern for adjustment in the main scanning direction and a cutting pattern for adjustment in the sub scanning direction. In proximity of the X direction adjustment pattern 115 is applied an X direction cutting pattern 125 which is used as the cutting pattern 120 for adjustment in the sub scanning direction.

As with the origin point adjusting image 110, the cutting pattern 120 is marked with graduations. This is referred to as a cutting-side scale 121 marked with a plurality of graduations. In, for instance, the X direction cutting pattern 125, the graduations of the cutting-side scale 121 are extending in the main scanning direction and spaced at certain intervals in the sub scanning direction. The cutting pattern 120 is applied on the medium M such that intervals between the graduations of the cutting-side scale 121 are displaced by a predetermined dimension relative to intervals between the graduations of the image-side scale 111 of the origin point adjusting image 110.

After the cutting pattern 120 is applied in the described manner, of the graduations of the image-side scale 111 in the origin point adjusting image 110, one of the graduations closest in the sub scanning direction to the graduation of the cutting-side scale 121 of the cutting pattern 120 is chosen. A numeral printed in proximity of the chosen graduation of the image-side scale 111×0.1 mm represents an amount of misalignment between the printing position and the cutting position. The numeral of 0 printed in proximity of the graduation of the image-side scale 111 closest in the sub scanning direction to the graduation of the cutting-side scale 121 indicates a substantial matching between the printing origin point and the cutting origin point, strongly suggesting there may be almost no misalignment between the printing position and the cutting position.

Figure 13:
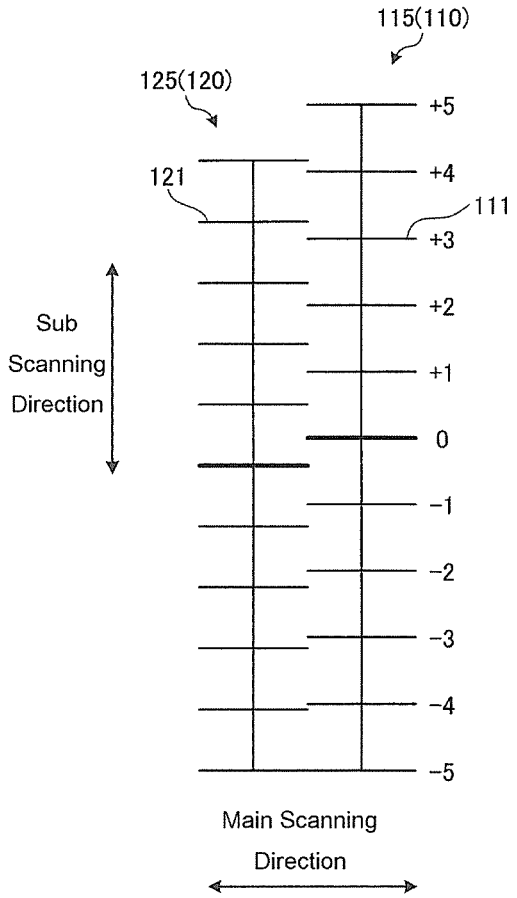
FIG. 13 is an explanatory drawing of examples of the origin point adjusting image and the cutting pattern when there is any misalignment between printing and cutting positions.

FIG. 13 is an explanatory drawing of examples of the origin point adjusting image and the cutting pattern when there is any misalignment between printing and cutting positions. In the event of the misaligned printing and cutting positions, there is a substantial matching in position in the sub scanning direction between the graduations of the cutting-side scale 121 and all of the graduations of the image-side scale 111 but the graduation with 0 printed in its proximity. In the event of misalignment between the printing and cutting positions with the numeral of −5 printed in proximity of the graduation of the image-side scale 111 closest in the sub scanning direction to the graduation of the cutting-side scale 121 as illustrated in FIG. 13, −5×0.1 mm=−0.5 mm is the amount of misalignment between the printing position and the cutting position in the sub scanning direction.

Figure 14:
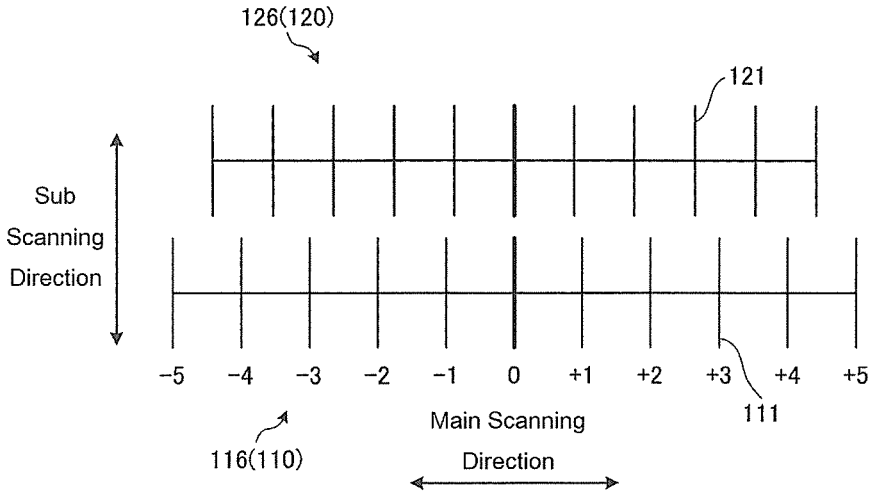
FIG. 14 is an explanatory drawing of a Y direction adjustment pattern of the origin point adjusting image and a cutting pattern.

FIG. 14 is an explanatory drawing of a Y direction adjustment pattern of the origin point adjusting image and a cutting pattern. To detect an amount of misalignment between the printing position and the cutting position in the main scanning direction, similarly, the origin point adjusting image 110 is printed on the medium M and the cutting pattern 120 is applied nearby. In, for instance, a Y direction adjustment pattern 116 as the origin point adjusting image 110 used for adjustment between the printing position and the cutting position in the main scanning direction, the graduations of the image-side scale 111 are extending in the sub scanning direction and spaced at certain intervals in the main scanning direction. In the Y direction adjustment pattern 116, numerals used as indicators of values of corrections for the printing-cutting position alignment are printed correspondingly to the graduations of the image-side scale 111.

After the Y direction adjustment pattern 116 is printed, a Y direction cutting pattern 126, which is the cutting pattern 120 for adjustment in the main scanning direction, is applied in proximity of the Y direction adjustment pattern 116. In the Y direction cutting pattern 126, the graduations of the cutting-side scale 121 are similarly extending in the sub scanning direction and spaced at certain intervals in the main scanning direction. After the Y direction cutting pattern 126 is applied, of the graduations of the image-side scale 111 in the Y direction adjustment pattern 116, one of the graduations closest in the main scanning direction to the graduation of the cutting-side scale 121 of the Y direction cutting pattern 126 is chosen. A numeral printed in proximity of the chosen graduation of the image-side scale 111×0.1 mm represents the amount of misalignment between the printing position and the cutting position in the main scanning direction.

As described so far, the amounts of misalignment between the printing position and the cutting position in both of the main and scanning directions are obtained by using the origin point adjusting image 110 and the cutting pattern 120. Then, the obtained amounts of misalignment are inputted to the controller 20 as values of correction between the printing position and the cutting position. Then, the printing position and the cutting position may be easily located at substantially the same position, and the printing and cutting operations may be performed respectively at the adjusted positions. Thus, adjustment of the printing-cutting origin points may be advantageously facilitated.

Modified Embobiment

The printing position and cutting position adjusting method according to the first embodiment performs the check process during the cutting of the medium M. The check process may be performed during the printing of the origin point adjusting image 70. To this end, the medium M is cut by the cutting head 50 in accordance with the cutting data generated based on the origin point adjusting image 70. The printing by the ink-jet head 15 is performed with a position shift being produced relative to the position of each of the checking blocks 72 in the origin point adjusting image 70 by a predetermined dimension in the main scanning direction or the sub scanning direction. Then, the amount of misalignment relative to the checking block 72 where the cutting and printing positions are coincident may be used as the value of correction between the printing position and the cutting position. This may also facilitate the printing-cutting origin point adjustment.

The printing position and cutting position adjusting method according to the first embodiment is capable of performing the check process in both of the main and sub scanning directions at the interval of 0.1 mm at a time within the range of −1.3 mm to 1.3 mm. The range and the interval are not necessarily limited to these values.

The ink-jet printer 1 according to the first embodiment cures the ink discharged on the medium M by irradiating ultraviolet on the ink. The ink-jet printer 1 may cure the ink by employing a means other than the ultraviolet irradiation. For example, the ink-jet printer 1 may have a heater as a heat source to heat and dry the ink discharged on the medium M. As far as any optional image can be printed on the medium M by discharging the ink thereon, any means may be used to dry the discharged ink.

Figure 15:
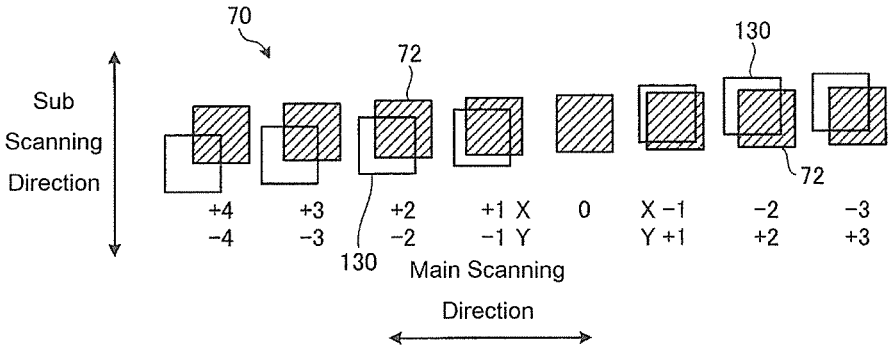
FIG. 15 is an explanatory drawing when misalignment between the printing position and the cutting position is detected by the use of one origin point adjusting image.

The printing position and cutting position adjusting method according to the first embodiment prints the X direction adjustment pattern 75 and the Y direction adjustment pattern 76 as the origin point adjusting image 70, thereby cutting the medium M. Instead, one origin point adjusting image 70 may be used to detect any misalignment between the printing and cutting positions. FIG. 15 is an explanatory drawing when misalignment between the printing position and the cutting position is detected by the use of one origin point adjusting image. For misalignment detection between the printing position and the cutting position using one origin point adjusting image 70, the origin point adjusting image 70 is printed such that its checking blocks 72 are spaced at given intervals in the main scanning direction, as with the first embodiment 1.

Numerals to be printed in proximity of the checking blocks 72 then are numerals used as indicators of values of correction for position alignment in the main scanning direction and numerals used as indicators of values of correction for position alignment in the sub scanning direction. These numerals for the two directions are respectively printed in proximity of the checking blocks 72 correspondingly to the checking blocks 72. For example, numerals used as indicators of values of correction in the main and sub scanning directions to be printed in proximity of the checking blocks 72 may be identical numerals whose plus and minus are reversed.

When the medium M is cut after the origin point adjusting image 70 is printed thereon, the medium M is cut based on a cutting pattern 130 in which a position shift relative to the cutting data is produced in both of the main and sub scanning directions by each of the checking blocks 72 in accordance with the numeral printed in its proximity. After the medium M is cut, the cut part is peeled off and removed from the medium M to choose the checking block 72 with the uncut part 77 smallest in width in the main scanning direction and the checking block 72 with the uncut part 77 smallest in width in the sub scanning direction.

Then, printed numerals are respectively extracted; a numeral for the main scanning direction printed in proximity of the checking block 72 with the uncut part 77 smallest in width in the main scanning direction, and a numeral for the sub scanning direction printed in proximity of the checking block 72 with the uncut part 77 smallest in width in the sub scanning direction. The numerals thus extracted×0.1 mm are used as amounts of misalignment between the printing position and the cutting position in the main scanning direction and the sub scanning direction, and the amounts of misalignment are used as values of correction between the printing position and the cutting position.

Thus, even one origin point adjusting image 70 may be useful for detection of the amounts of misalignment between the printing position and the cutting position. One origin point adjusting image 70 may serve the purpose of detecting any misalignment between the printing and cutting positions in the main and sub scanning directions. This may reduce by half a detection region for detecting misalignment based on the origin point adjusting image 70 printed on the medium M.

When an image is printed on the medium M, the ink-jet printer 1 prints, in addition to the image, generally called register marks. The register mark is a target based on which the position and scale of the medium M to be cut is adjusted relative to the image. The ink-jet printer 1 may apply the amount of printing-cutting misalignment calculated based on the origin point adjusting image 70 to obtain adjusted values of the register marks. Specifically, when the ink-jet printer 1 prints the register marks and tries to locate the cutter blades 53 of the cutting head 50 on the register marks but fails, resulting in misalignment of the cutter blades 53 to the register marks, the printer 1 inputs offset adjusted values of the register marks for alignment of the positions of the cutter blades 53 to the positions of the register marks. By applying the value of correction between the printing position and the cutting position obtained from the origin point adjusting image 70 to the offset adjusted values of the register marks, these offset adjusted values may be easily decided. Then, alignment of the positions of the cutter blades 53 to the positions of the register marks may be accordingly facilitated.

What is claimed is:

1. A printing position and cutting position adjusting method, comprising:

printing on a medium an origin point adjusting image having a plurality of checking blocks using an ink-jet head that discharges an ink on the medium for printing;

cutting the medium using a cutting head along a contour of the origin point adjusting image;

removing a part of the medium cut by the cutting head from the medium; and inputting an amount of misalignment between a position at which the image is printed on the medium and a position at which the medium is cut to a controller that controls the ink-jet head and the cutting head, the amount of misalignment being inputted as a value of correction between the position of printing by the ink-jet head and the position of cutting by the cutting head, wherein the printing of the origin point adjusting image or the cutting of the medium includes:

a check process of producing a position shift per a predetermined dimension by each of the plurality of checking blocks in a main scanning direction or a sub scanning direction of the ink-jet head;

wherein the plurality of checking blocks of the origin point adjusting image are coupled by a coupling section.

2. The printing position and cutting position adjusting method according to claim 1, wherein the check process is performed during the cutting of the medium.

3. The printing position and cutting position adjusting method according to claim 2, wherein the check process is performed in the main scanning direction and the sub scanning direction, respectively.

4. The printing position and cutting position adjusting method according to claim 3, wherein the origin point adjusting image is printed such that an image subjected to the check process in the main scanning direction and an image subjected to the check process in the sub scanning direction are respectively printed on the medium.

5. The printing position and cutting position adjusting method according to claim 1, wherein the check process is performed in the main scanning direction and the sub scanning direction, respectively.

6. The printing position and cutting position adjusting method according to claim 5, wherein the origin point adjusting image is printed such that an image subjected to the check process in the main scanning direction and an image subjected to the check process in the sub scanning direction are respectively printed on the medium.

7. The printing position and cutting position adjusting method according to claim 1, wherein the check process is performed in the main scanning direction and the sub scanning direction, respectively.

8. The printing position and cutting position adjusting method according to claim 7, wherein the origin point adjusting image is printed such that an image subjected to the check process in the main scanning direction and an image subjected to the check process in the sub scanning direction are respectively printed on the medium.

* * * * *